US009514643B2

(12) United States Patent
Fitzgibbon

(10) Patent No.: US 9,514,643 B2
(45) Date of Patent: Dec. 6, 2016

(54) ABOVE GROUND LOOP SYSTEM PROXIMITY DETECTION

(71) Applicant: The Chamberlain Group, Inc., Elmhurst, IL (US)

(72) Inventor: James J. Fitzgibbon, Batavia, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 74 days.

(21) Appl. No.: 14/551,889

(22) Filed: Nov. 24, 2014

(65) Prior Publication Data

US 2016/0148504 A1 May 26, 2016

(51) Int. Cl.

| | |
|---|---|
| ***G08G 1/042*** | (2006.01) |
| ***G08G 1/015*** | (2006.01) |
| ***G07B 15/04*** | (2006.01) |
| ***G08G 1/056*** | (2006.01) |

(52) U.S. Cl.

CPC ..... *G08G 1/042* (2013.01); *G07B 15/04* (2013.01); *G08G 1/015* (2013.01); *G08G 1/056* (2013.01)

(58) Field of Classification Search

CPC ..... G08G 1/042; G08G 1/015; G08G 1/056; G08G 1/01; G07B 15/00; G07B 15/04

See application file for complete search history.

(56) References Cited

U.S. PATENT DOCUMENTS

| | | | | |
|---|---|---|---|---|
| 2,917,732 A | | 12/1959 | Chase et al. | |
| 3,651,452 A | | 3/1972 | Friedman | |
| 4,392,119 A | * | 7/1983 | Price | G08G 1/065 336/84 M |
| 5,323,151 A | | 6/1994 | Parsadayan | |
| 5,491,475 A | | 2/1996 | Rouse | |
| 5,844,502 A | | 12/1998 | Perez | |
| 6,100,820 A | * | 8/2000 | Pieverling | G01V 3/102 340/934 |
| 6,546,344 B1 | | 4/2003 | Rodrian | |
| 7,132,959 B2 | | 11/2006 | Seabury | |
| 7,221,289 B2 | | 5/2007 | Hom | |
| 7,324,014 B2 | * | 1/2008 | Parsadayan | H04B 5/005 324/200 |
| 7,345,595 B1 | * | 3/2008 | Heckman, Jr. | G08G 1/042 324/207.2 |
| 8,331,621 B1 | * | 12/2012 | Allen | G08G 1/015 235/384 |
| 2005/0035880 A1 | * | 2/2005 | Roland | G08G 1/042 340/941 |
| 2013/0117078 A1 | * | 5/2013 | Weik, III | G06Q 10/00 705/13 |

* cited by examiner

*Primary Examiner* — Andrew Bee

(74) *Attorney, Agent, or Firm* — Fitch Even Tabin & Flannery LLP

(57) ABSTRACT

A loop detection apparatus and corresponding methods are provided that includes an inductive loop and a processing device. The processing device includes circuitry to connect to the inductive loop and control and sense from the inductive loop a change in a characteristic thereof. The inductive loop is disposed at least partially above a surface on which a vehicle travels. The processing device detects a change in a characteristic of the inductive loop beyond a first threshold value, and in response, transmits a first signal configured to effect a first action. The processing device further detects a change in the characteristic of the inductive loop beyond a second threshold value, and in response, transmits a second signal configured to effect a second action different than the first action.

17 Claims, 5 Drawing Sheets

ABOVE GROUND LOOP SYSTEM PROXIMITY DETECTION

TECHNICAL FIELD

This invention relates generally to sensing the presence of a vehicle, and more particularly, sensing the presence of a vehicle using a loop detector.

BACKGROUND

Loop detector apparatuses are commonly used in roadways and other ground surfaces on which a vehicle travels. Generally speaking, these loop detector apparatuses include an inductive loop, a detecting mechanism, and a cable coupling the inductive loop to the detecting mechanism. The detecting mechanism provides the inductive loop with power, which creates a magnetic field in the inductive loop area having a frequency that is monitored by the detecting mechanism. When a vehicle or other metallic object passes over the inductive loop, the frequency increases. The detecting mechanism senses this increase in frequency and causes a device to perform an action.

These apparatuses may be used for a variety of different purposes, for example when detecting the presence of a vehicle waiting at a traffic light. Upon the inductive loop detecting the presence of the vehicle, the inductive loop may then transmit a signal to a device which causes the traffic light to change, thus allowing the vehicle to resume travel. In other systems, loop detector apparatuses may be employed in commercial settings to allow access to a warehouse or dock service door.

Many of these systems require the inductive loop to be buried a sufficient depth under the ground surface. As a result, installation of these apparatuses may be costly due to the below-ground placement of the loop. Further, improper installations may create difficulties in accurately sensing the presence of a vehicle. Even assuming proper installation of these apparatuses does occur, due to varying vehicle sizes, the apparatus may be unable to accurately measure a change in frequency. For example, one type of vehicle (such as a sports car) may have a low center of gravity with sufficient amounts of metal at a distance that is close enough to the inductive loop to accurately sense a change in frequency when the vehicle rolls over the inductive loop. Other types of vehicles (such as a sport utility vehicle or a delivery truck, to name a few examples) may have a higher center of gravity with a lesser amount of metal located at a distance necessary to obtain an increase in frequency. As a result, the detecting mechanism may not detect the presence of these vehicles. Other vehicle characteristics may also lead to the failure to accurately detect the vehicle.

BRIEF DESCRIPTION OF THE DRAWINGS

The above needs are at least partially met through provision of the above ground loop system proximity detection and related methods described in the following detailed description, particularly when studied in conjunction with the drawings, wherein.

Figure 2:
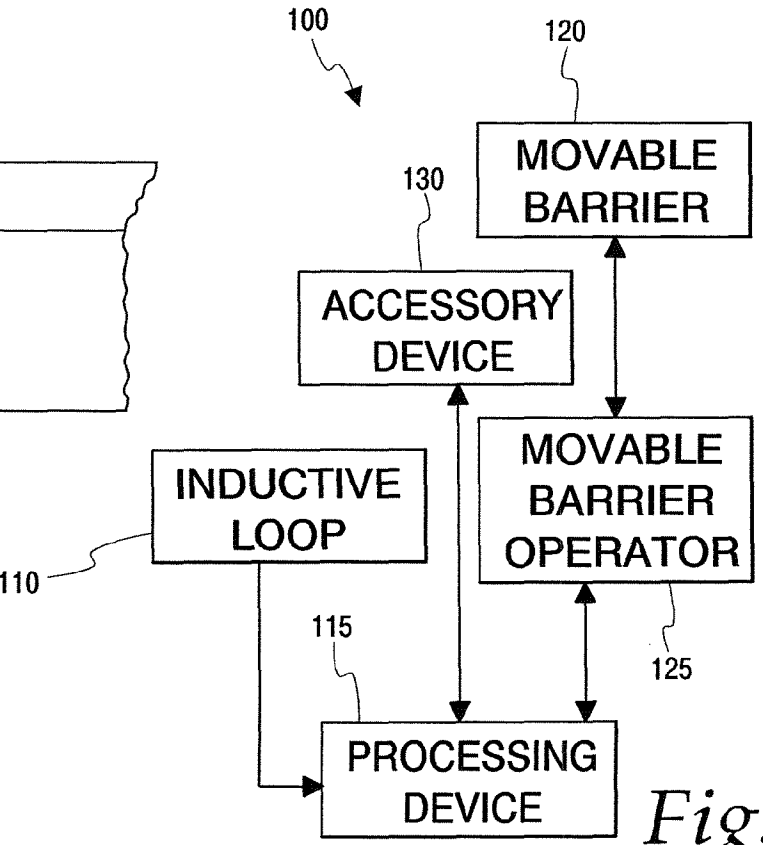
FIG. 2 comprises a block diagram of a loop detection apparatus as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a loop detection apparatus includes an inductive loop that is configured to be disposed at least partially above a surface on which a vehicle travels and a processing device having circuitry configured to connect to the inductive loop and sense a change in a characteristic (for example, a change in inductance) of the inductive loop. Upon detecting a change in a characteristic of the inductive loop beyond a first threshold value, the processing device is configured to transmit a first signal configured to effect a first action.

So configured, the loop detection apparatus may be placed in a number of configurations and does not need to be installed below a ground surface to detect the presence of a vehicle. By disposing the inductive loop at least partially above the surface on which the vehicle travels, costly installations requiring asphalt or other materials to be cut, trenched, or removed may be avoided. Further, by positioning the inductive loop at least partially above the surface on which the vehicle travels, the processing device, when sensing the change in the characteristic of the inductive loop, will encounter less signal attenuation due to the lack of the ground surface separating the inductive loop and the vehicle. Accordingly, the loop detection apparatus may detect a change in inductance of the inductive loop to accurately detect the presence of vehicles having any number of shapes and sizes.

The loop detection apparatus may be coupled to any number of mounting surfaces in a variety of environments. For example, the loop detection apparatus may be coupled to a movable barrier having any number of different configurations or uses, such as in a commercial loading dock or residential security gate. The inductive loop may be a full or partial loop structure that is placed directly on a movable barrier or on a surface near the movable barrier, for example, on a wall.

In some examples, upon the detection apparatus detecting the presence of a vehicle, a number of different devices may be activated and/or actuated. For example, the detection apparatus may cause a movable barrier to be opened or closed, an illumination system to be activated, a wired or wireless communications system to be activated, and/or a security alarm or home automation system to be activated. In other examples, the detection apparatus may act as a proximity sensing device that limits movement of a movable barrier to avoid injury. In these examples, when the detection apparatus senses a change in inductance of the inductive loop, the detection apparatus may transmit a signal to cease movement of the movable barrier.

Figure 1:
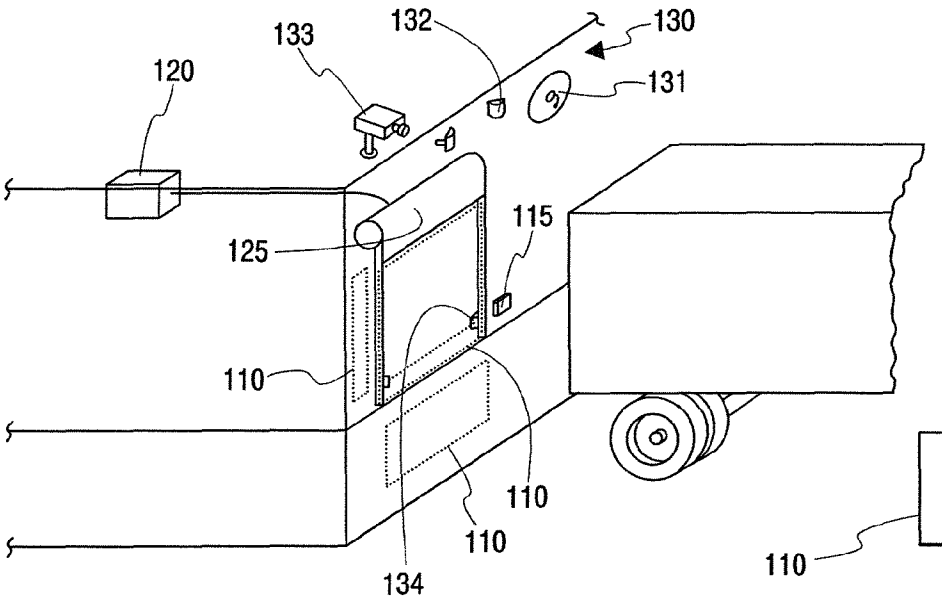
FIG. 1 comprises a perspective view of an example commercial loading dock with a loop detection system and accessory devices as configured in accordance with various embodiments of the invention.
Figure 3:
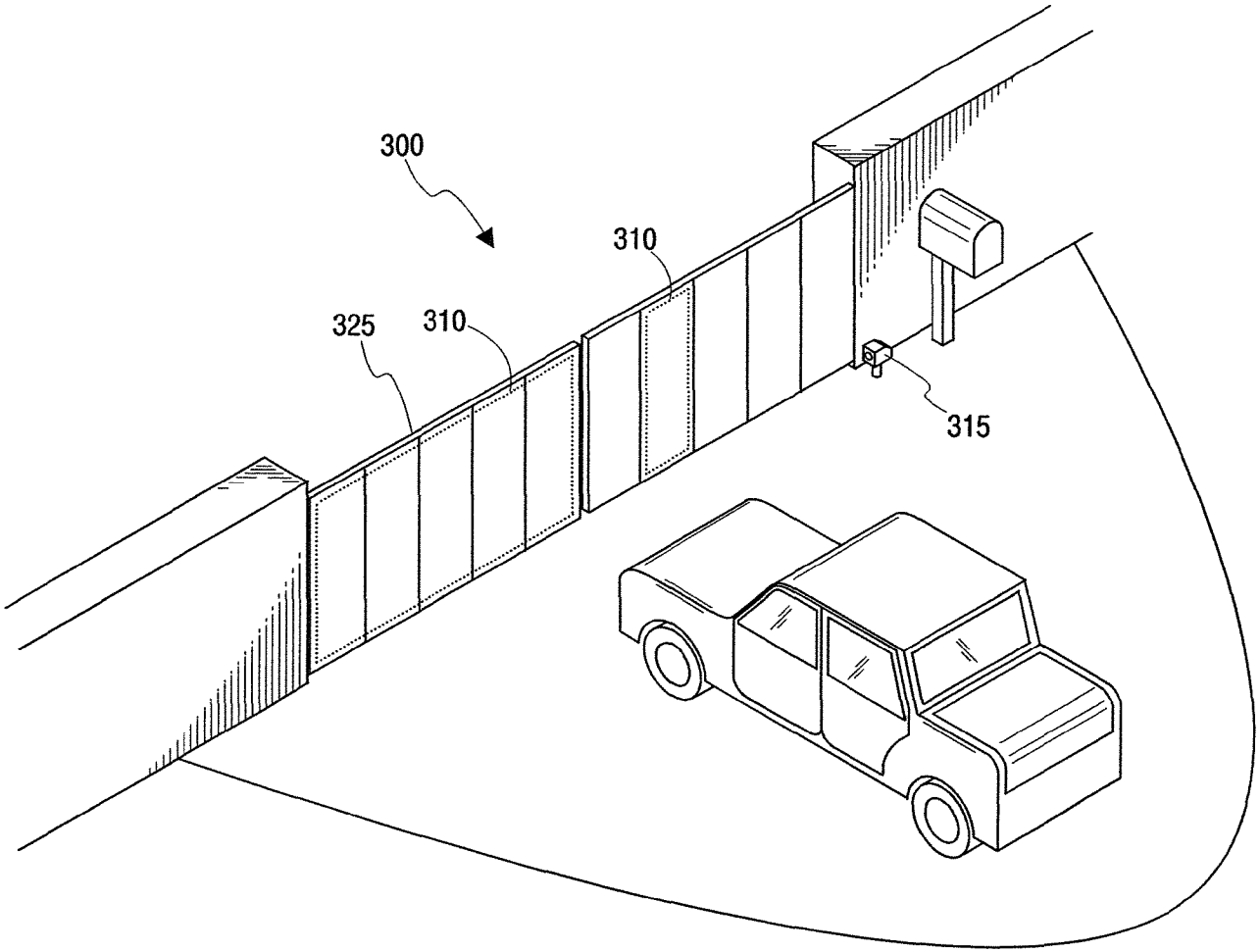
FIG. 3 comprises a perspective view of an example residential gate having a loop detection system as configured in accordance with various embodiments of the invention.
Figure 4:
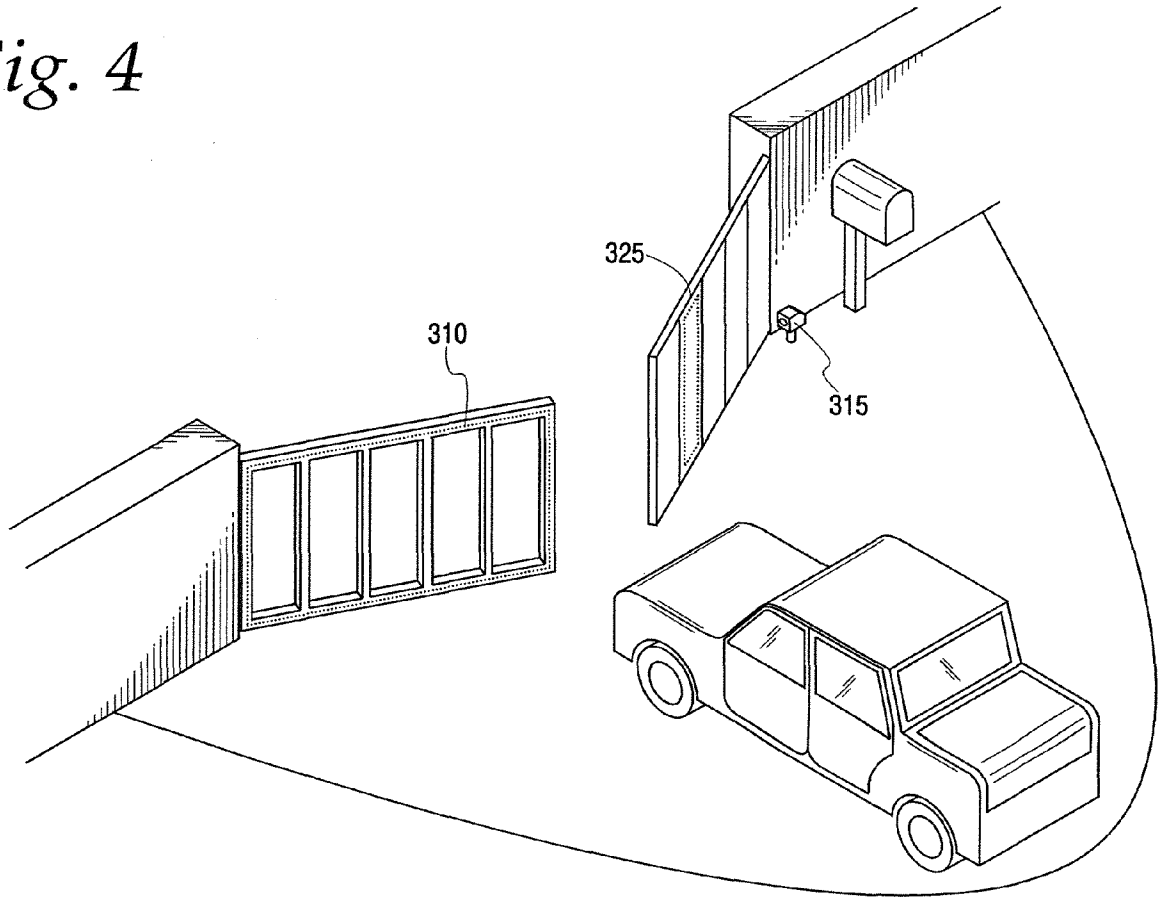
FIG. 4 comprises a perspective view of the example residential gate of FIG. 3 being in a partially opened position as configured in accordance with various embodiments of the invention.

These and other benefits may become clearer upon making a thorough review and study of the following detailed description. Referring now to the drawings, and in particular to FIGS. 1 and 2, a loop detection system 100 may be disposed in a commercial loading dock environment and include an inductive loop 110 and a processing device 115. The commercial loading dock environment 100 may also include a movable barrier operator 120, a movable barrier 120, and any number of accessory devices 130 such as an alarm system 131, an illumination system 132, and a security monitoring system 133 which may include a camera or a video camcorder, and a photo beam sensing system 134. Other examples of accessory devices 130 may include an audible signal or communications system such as an intercom system.

The inductive loop 110 may be any conventional loop and may be constructed of a continuous wire or any number of connected sections. In some examples, the inductive loop 110 is a fully enclosed loop, but it is understood that in some examples, the inductive loop 110 may be a partial loop configuration that eliminates the need for one or more sides of the inductive loop 110.

The processing device 115 may be any device having circuitry configured to connect to the inductive loop 110. The processing device 115 may be coupled to the inductive loop 110 through a wired or wireless connection. For example, the inductive loop 110 may be a single wire that includes a loop portion and a portion extending from the loop portion to the processing device 115. In other forms, the inductive loop 110 may be connected to the processing device 115 through any type of cable capable of transferring signals or data. In still other forms, the inductive loop 110 is connected to the processing device 115 wirelessly using any commonly-known wireless communication protocol such as a wireless fidelity a/b/g/n network (Wi-Fi), Bluetooth, infrared (IR) communication, near-field communication (NFC), and/or radio frequency (RF) networks. Other examples are envisioned.

The circuitry of the processing device 115 is configured to connect to the inductive loop 110 and control and sense from the inductive loop 110 a change in a characteristic. For example, the processing device 115 may be configured to sense a change in inductance of the inductive loop. In other examples, the processing device 115 is configured to sense a change in the eddy or Foucault current by detecting energy loss in the inductive loop.

The processing device 115 is also communicatively coupled to any number of devices such as the movable barrier operator 120 configured to effectuate movement of the movable barrier 125 as well as to effectuate actions at the accessory devices 130 such as the security monitoring system 133, illumination system 132, and alarm system 131. The processing device 115 may be coupled to these devices using any known wired or wireless methods known to those in the art.

The inductive loop 110 is configured to be disposed at least partially above a surface on which a vehicle travels such as, for example, a ground surface or roadway. In some forms, the inductive loop 110 is configured to be disposed proximate to a vehicle pathway, access to which is periodically restricted by the movable barrier 125 controlled by the movable barrier operator 120. By way of a non-limiting example, in FIG. 1, the inductive loop 110 is shown being positioned in numerous configurations. The inductive loop 110 may be disposed directly on a movable barrier 125, on a surface adjacent to the movable barrier 125 or on any combination of the two. By disposing the inductive loop 110 at least partially above a surface on which a vehicle travels, installation costs are reduced due to eliminating the need to cut into the ground surface to dispose the inductive loop 110 therein.

In operation, the processing device 115 is configured to detect a change in a characteristic of the inductive loop 110 beyond a first threshold value. For example, if the processing device 115 is configured to sense from the inductive loop 110 a change in inductance thereof, the processing device senses a change beyond a first threshold value. This threshold value may be representative of an inductance measurement in which a vehicle is within a specified proximity to the inductive loop 110 and may be customized by a user based on particular system requirements.

In response to detecting the change in the characteristic of the inductive loop 110 beyond the first threshold value, the processing device 115 is configured to transmit a first signal configured to effect a first action. For example, the processing device 115 may be configured to transmit a signal to the movable barrier operator 120, which causes the movable barrier operator 120 to effect movement of the movable barrier 125 (e.g., to open or close), causes the movable barrier operator 120 to restrict movement of the movable barrier 125 (e.g., stopping the movable barrier 125 from closing), and/or causes any number of accessory devices 130 to be actuated or initialized.

As such, when the processing device 115 senses a change in the characteristic of the inductive loop 110, the processing device may 115 instruct the movable barrier operator 120 to open the movable barrier 125. Thus, the processing device 115 may detect a change in the characteristic of the inductive loop 110 corresponding to an approaching vehicle and automatically cause the movable barrier 125 to be opened. In other examples, if the processing device 115 is configured to detect a change in the characteristic of the inductive loop 110 corresponding to an approaching vehicle, the processing device 115 may be configured to initialize any number of accessory devices 130 as security measures. Thus, the processing device 115 may cause the illumination system 132 to be activated, the security system 133 to begin capturing pictures or recording video, or the audible alarm 131 to sound. Alternatively, the processing device 115 may be configured to detect a change in the characteristic corresponding to a departing vehicle and automatically cause the movable barrier 125 to be closed.

In some forms, the processing device 115 is configured to detect a change in the characteristic of the inductive loop 110 beyond a second threshold value. This second threshold value may correspond to a greater or lesser change in the characteristic of the inductive loop 110 depending on the desired configuration. In other words, this change in the characteristic of the inductive loop 110 beyond a second threshold value may correspond to a greater or lesser inductance measurement detected by the processing device 115, which in turn may correspond to a vehicle moving closer to or further away from the inductive loop 110. Accordingly, the loop detection apparatus 100 may act as a proximity and distance sensor, detecting both the presence of a vehicle and whether it is moving closer to or away from the inductive loop 110.

In response to detecting this change beyond the second threshold value, the processing device 115 is configured to transmit a second signal to effect a second action different from the first action. These actions may include causing the movable barrier operator 120 to effect movement of the movable barrier 125 (e.g., to open or close), causing the movable barrier operator 120 to restrict movement of the movable barrier 120 (e.g., stopping the movable barrier 125 from closing) and/or causing any number of accessory devices 130 to be actuated or initialized. Thus, the loop detection apparatus 100 may be configured to perform multiple, different actions depending on both the presence of the vehicle and its relative proximity to the inductive loop 110.

As a non-limiting example, the loop detection apparatus 100 may be configured to activate the illumination system 132 when the processing device 115 detects a change in the characteristic beyond a first threshold value. This first threshold value may correspond to a vehicle being approximately five to ten feet from the inductive loop 110. Upon the vehicle's continued movement towards the inductive loop 110, the processing device 115 may detect a change in the characteristic beyond a second threshold value. The second threshold value may correspond to a vehicle being approximately one to four feet from the inductive loop 110. At this point, the movable barrier operator 120 may cause the movable barrier 125 to open, or allow opening of the movable barrier 125 in conjunction with a received authorization. Accordingly, the loop detection apparatus 100 may assist a driver of a vehicle in properly aligning their vehicle with the movable barrier 125 by providing suitable illumination and subsequently open the movable barrier 125 to allow access to the secured environment. It is understood that these distances are merely exemplary and that other ranges or values are envisioned.

As another non-limiting example, the loop detection apparatus 100 may be configured to cause the illumination and/or security systems 132, 133 to be actuated in response to the processing device 115 detecting the characteristic of the inductive loop 110 beyond the first threshold. If the vehicle continues to move towards the inductive loop 110, the processing device 115 may detect the characteristic of the inductive loop 110 exceeding the second threshold value, and thus may activate the audible alarm 131. Accordingly, the loop detection apparatus 100 may serve as a device to deter access to a particular area.

In yet another non-limiting example, the vehicle may be preparing to leave the loading dock environment. The loop detection apparatus 100 may be configured to actuate the illumination system 132 upon the processing device 115 detecting the characteristic of the inductive loop 110 beyond the first threshold, in this case corresponding to the vehicle moving from a position adjacent or near the inductive loop 110 to a position further away from the inductive loop 110. Upon the vehicle's continued departure from the loading dock environment, the loop detection apparatus 100 may be configured to cause the movable barrier operator 120 to close the movable barrier 125 in response to the processing device 115 detecting the characteristic of the inductive loop exceeding the second threshold, which corresponds to the vehicle moving to a distance further away from the inductive loop 110. Accordingly, the loop detection apparatus 100 may reduce the risk of injury by closing the movable barrier when a vehicle is not positioned adjacent thereto.

With reference to FIGS. 3-6, additional examples of a loop detection apparatus 300 incorporated into a residential environment will be described. It is understood that components in the loop detection apparatus 300 correspond to those in the loop detection apparatus 100 of FIGS. 1-2, and accordingly, similar components will not be discussed in detail. The loop detection apparatus 300 may include an inductive loop 310, a processing device 315, and a movable barrier 325, that is controlled by a movable barrier operator (not shown). It is understood that the loop detection apparatus 300 may further include any number of accessory devices (not shown) as described with regards to FIGS. 1-2.

Figure 5:
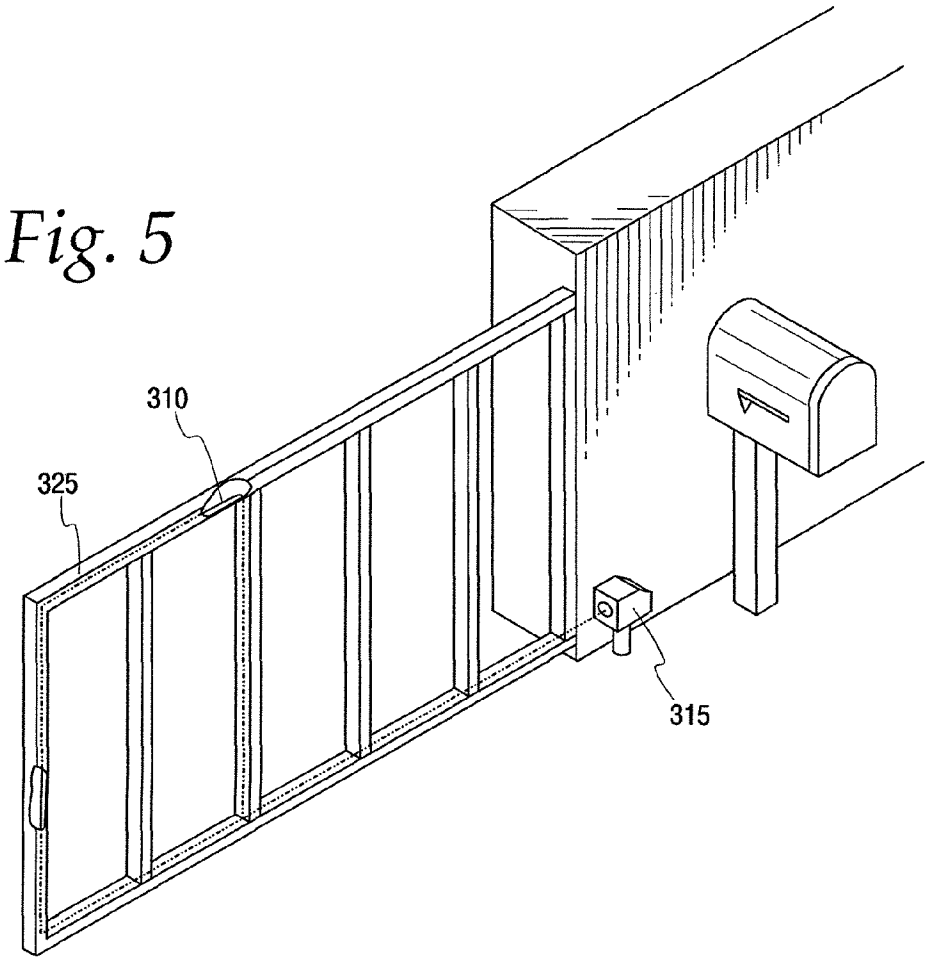
FIG. 5 comprises a perspective view of the example residential gate of FIG. 3 having the inductive loop installed inside the gate as configured in accordance with various embodiments of the invention.
Figure 6:
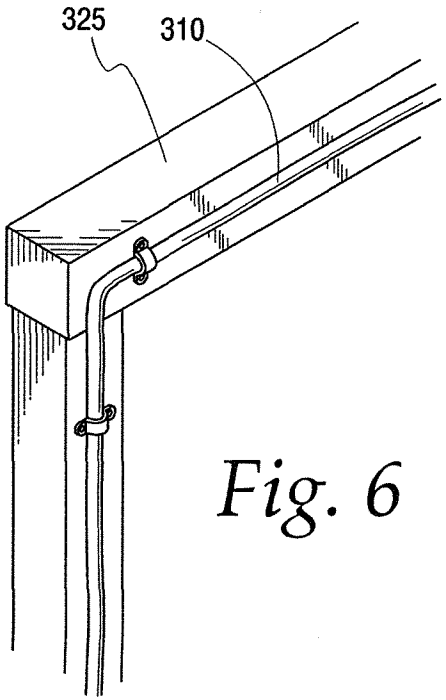
FIG. 6 comprises a perspective view of the example residential gate of FIG. 3 having the inductive loop installed on an outer surface of the gate as configured in accordance with various embodiments of the invention.

The movable barrier 325 may be any barrier that restricts access to an area, and may be, for example, a fence or other security gate. The inductive loop 310 may be disposed on an area encompassing an entire portion of the movable barrier 325 or may be disposed on a smaller section thereof. In some examples and as illustrated in FIG. 5, the inductive loop 310 is built directly into the movable barrier 325. As such, the movable barrier 325 retains its visual appeal and does not require trenching or other costly installation practices. In other examples and as illustrated in FIG. 6, the inductive loop 310 is secured to a surface of the movable barrier 325 using any number of conventional methods such as screws, adhesives, magnets, staples, and the like. Other examples are envisioned. As such, the inductive loop 310 may be used as an add-on feature should a consumer wish to incorporate the system into an existing environment.

In operation, in response to the processing device 315 detecting a characteristic of the inductive loop 310 is beyond a first threshold, the processing device 315 transmits a signal to effect a first action. For example, the first threshold may correspond to the vehicle approaching the movable barrier 325. The processing device 315 may cause the movable barrier 325 to open upon detecting the presence of this vehicle. In the event that the processing device 315 detects a characteristic of the inductive loop 310 beyond a second threshold, the processing device 315 may transmit a signal to effect a second action. For example, this second threshold may correspond to the vehicle being prohibitively close to the movable barrier 325 to allow it to properly open. The processing device 315 may cause the movable barrier 325 to cease movement and/or reverse to a closed position upon detecting the characteristic exceeding the second threshold.

In an alternative example, in response to the processing device 315 detecting the characteristic of the inductive loop 310 beyond the first level, the processing device 315 may cause an accessory device (not shown) such as an illumination or intercom system to be activated. In response to the processing device 315 detecting the characteristic of the inductive loop 310 beyond the second level, the processing device 315 may transmit a signal to cause the movable barrier to be moved. Thus, upon departure and/or arrival of a vehicle, the loop detection apparatus 300 may activate an accessory device and cause the movable barrier 325 to be opened or closed based on the detection of the processing device 315. In some forms, detecting the characteristic of the inductive loop 310 beyond the second level may cause movement of the movable barrier to be halted. In such an example, the vehicle may have stopped while traversing the opening of the movable barrier 325, and thus movement of the movable barrier 325 at this time may cause damage to the vehicle. Accordingly, the loop detection apparatus 300 may be configured to act as a proximity sensor to ensure safety.

It is understood that in some examples the loop detection system 300 may be configured to solely detect a change in characteristic of the inductive loop 310 beyond a first threshold. The processing device 315 may transmit a signal to a remote device to alert an individual of the presence of a vehicle who may then transmit a signal to the processing device 315 to allow or restrict access to the area by causing the movable barrier to be opened or maintaining the closed orientation, respectively. These communications may be over any known communications network using any number of known protocols.

In other examples, the inductive loop 310 may be coupled to or provided on a post disposed a distance from the movable barrier 325. Because movable barriers of this sort may have large dimensions, the vehicle would need to maintain a safe distance to allow the movable barrier to safely open. By disposing the inductive loop on a post that is disposed at a location that allows the presence of the vehicle to be detected while still allowing the movable barrier to travel its full range of motion, less user interaction may be required. Disposing the inductive loop on a post located a distance away from the movable barrier may also be beneficial in agricultural environments in which animals are free to traverse secured areas. In these examples, by disposing the inductive loop on or in these movable barriers, signals would frequently be transmitted that indicate the presence of an object. Further, animal deterrents may be incorporated in the movable barrier which may cause interference with the inductive loop. Thus, by placing the inductive loop at a distance from the movable barrier, potential interference with cattle deterrents and/or the possibility for false alarms based on animals or other objects is reduced.

With any of the examples provided herein, the signals transmitted by the processing device 115, 315 may cause any combination of devices and/or systems to be activated. Accordingly, the first transmitted signal may cause movement of the movable barrier in any desired direction, may cause movement to be halted, and/or may cause any number of accessory devices to be actuated, activated, and/or powered. Similarly, the second transmitted signal may cause any combination of events provided above that are different than the first transmitted signal. Consequently, the loop detection apparatus may function with vehicles approaching and/or departing a movable barrier, as well as with vehicles that have stopped in an opening created by the movable barrier.

Figure 7:
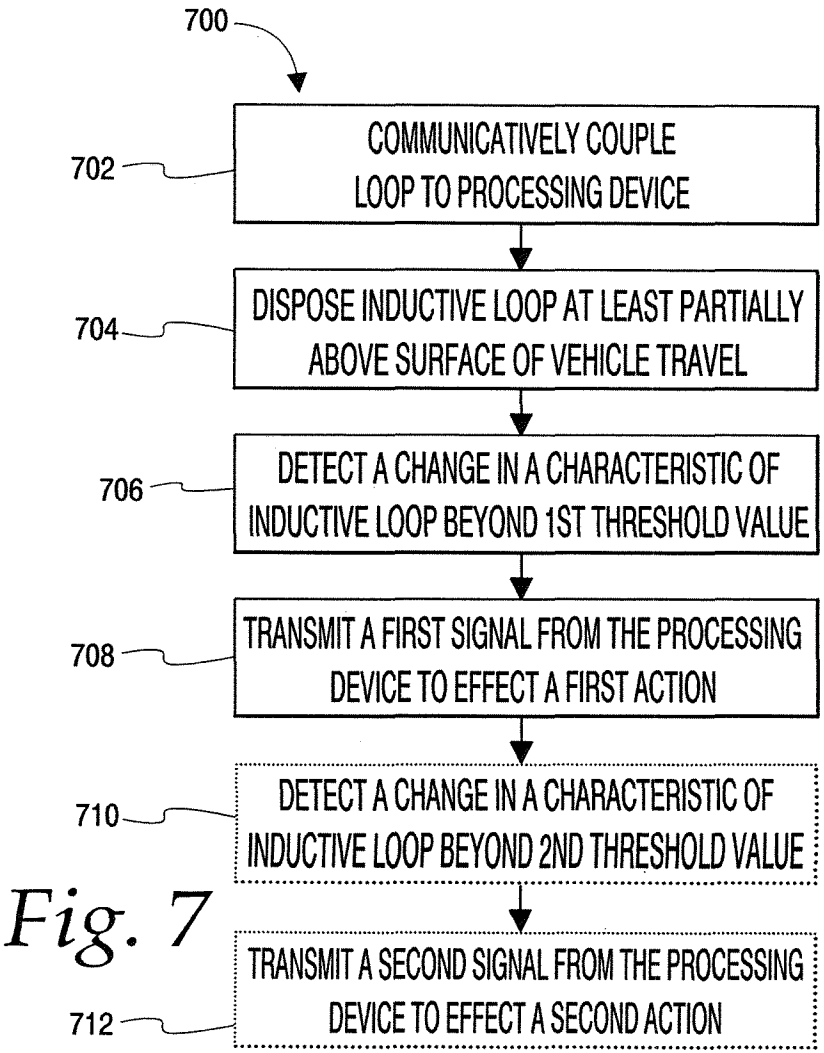
FIG. 7 comprises a flow diagram of a method of controlling a movable barrier operator system using a loop detector apparatus as configured in accordance with various embodiments of the invention.

Referring now to FIG. 7, a method 700 for controlling a movable barrier operator system using a loop detector apparatus having a processing device and an inductive loop is provided in further detail. The inductive loop is communicatively coupled 702 to a processing device and disposed 704 at least partially above a surface on which a vehicle travels. In some examples, disposing 704 the inductive loop may include supporting the inductive loop by the movable barrier. Next, at step 706, a change in a characteristic beyond a first threshold value is detected, and at step 708, in response to detecting the change in the characteristic beyond the first threshold value, a first signal is transmitted from the processing device to effect a first action in the movable barrier operator system.

In an alternative example, the step of disposing 704 the inductive loop comprises disposing the inductive loop proximate to a vehicle pathway in which access thereto is periodically restricted by a movable barrier controlled by a movable barrier operator. In this example, the step of transmitting 708 a first signal from the processing device may include one or more of causing the movable barrier operator to effect movement of the movable barrier, causing the movable barrier operator to restrict movement of the movable barrier, or causing an action by an accessory device associated with the movable barrier operator. For example, causing an action by an accessory device may include causing an action by an illumination system, a security monitoring system, an alarm system, an audible signal, or a photo beam sensing system.

In some examples, the method 700 may include detecting 710 a change in a characteristic of the inductive loop beyond a second threshold value different than the first. In response to detecting the change beyond the second threshold value, a second signal is transmitted 712 from the processing device to effect a second action in the movable barrier operator system different from the first action. In some examples, the step of transmitting 708 the first signal to effect the first action may include activating one or more accessory devices associated with the movable barrier. The step of transmitting 712 the second signal to effect the second action may include opening or closing the movable barrier. In other examples, the step of transmitting 708 the first signal to effect the first action includes allowing the movable barrier to be opened. The step of transmitting 712 the second signal to effect the second action may include halting the movable barrier and/or reversing the direction of the movable barrier.

So configured, the loop detection apparatus may be disposed on a number of surfaces and does not need to be installed below a ground surface to accurately detect the presence of a vehicle. By disposing the inductive loop at least partially above the ground surface, installation costs may be reduced, as the need for removing material from the ground surface may be reduced or eliminated. Additionally, the processing device will encounter less signal attenuation when sensing the change in the characteristic of the inductive loop, as the ground surface no longer separates the inductive loop and the vehicle. Further still, the loop detection apparatus may be used to accurately sense a vehicle's proximity to the inductive loop when disposed at least partially above a ground surface, thus allowing for any number of sequences or systems to be incorporated into the system.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A loop detection apparatus comprising:

an inductive loop;

a processing device comprising circuitry configured to connect to the inductive loop and sense from the inductive loop a change in inductance of the inductive loop; and wherein the inductive loop is configured to be disposed at least partially above a surface on which a vehicle travels, wherein the processing device is configured to detect a change in inductance of the inductive loop beyond a first threshold value, wherein in response to detecting the change in inductance of the inductive loop beyond the first threshold value, the processing device is configured to transmit a first signal configured to effect a first action, wherein the processing device is configured to detect a change in inductance of the inductive loop beyond a second threshold value, wherein in response to detecting the change in inductance of the inductive loop beyond the second threshold value, the processing device is configured to transmit a second signal to effect a second action different from the first action.

2. The loop detection apparatus of claim 1, wherein the inductive loop is configured to be disposed proximate to a vehicle pathway, access to which is periodically restricted by a movable barrier controlled by a movable barrier operator, and wherein the first signal transmitted by the processing device is configured to effect the first action comprising one or more of causing the movable barrier operator to effect movement of the movable barrier, causing the movable barrier operator to restrict movement of the movable barrier, or causing an action by an accessory device associated with the movable barrier operator.

3. The loop detection apparatus of claim 2, wherein the accessory device comprises at least one of: an illumination system; a security monitoring system; an alarm system; an audible signal; or a photo beam sensing system.

4. The loop detection apparatus of claim 2, wherein the first signal is configured to effect the first action by activating one or more accessory devices associated with the movable barrier.

5. The loop detection apparatus of claim 4, wherein the second signal is configured to effect the second action by causing the movable barrier to open.

6. The loop detection apparatus of claim 2, wherein the first signal is configured to effect the first action by allowing opening of the movable barrier.

7. The loop detection apparatus of claim 6, wherein the second signal is configured to effect the second action by one or both of halting and reversing the movable barrier.

8. The loop detection apparatus of claim 7, wherein the loop detector is disposed on at least a portion of the movable barrier.

9. A method for controlling a movable barrier operator system using a loop detector apparatus comprising a processing device and an inductive loop, the method comprising:

communicatively coupling the inductive loop to the processing device;

disposing the inductive loop at least partially above a surface on which a vehicle travels; detecting a change in inductance of the inductive loop beyond a first threshold value;

in response to detecting the change in inductance beyond the first threshold value, transmitting a first signal from the processing device to effect a first action in the movable barrier operator system;

detecting a change in inductance of the inductive loop beyond a second threshold value different than the first threshold value; and in response to detecting the change in inductance beyond the second threshold value, transmitting a second signal from the processing device to effect a second action in the movable barrier operator system different from the first action.

10. The method of claim 9, wherein the disposing the inductive loop comprises disposing the inductive loop proximate to a vehicle pathway, access to which is periodically restricted by a movable barrier controlled by a movable barrier operator; and wherein the transmitting the first signal comprises one or more of: causing the movable barrier operator to effect movement of the movable barrier; causing the movable barrier operator to restrict movement of the movable barrier; or causing an action by an accessory device associated with the movable barrier operator.

11. The method of claim 10, wherein the causing an action by an accessory device comprises at least one of causing an action by an illumination system, causing an action by a security monitoring system, causing an action by an alarm system, causing an action by an audible signal, or causing an action by a photo beam sensing system.

12. The method of claim 10, wherein the transmitting the first signal to effect the first action comprises activating one or more accessory devices associated with the movable barrier.

13. The method of claim 12, wherein the transmitting the second signal to effect the second action comprises opening the movable barrier.

14. The method of claim 10, wherein the transmitting the first signal to effect the first action comprises allowing the movable barrier to be opened.

15. The method of claim 14, wherein the transmitting the second signal to effect the second action comprises one or both of halting the movable barrier and reversing the movable barrier.

16. The method of claim 15, wherein the step of disposing the inductive loop comprises supporting the inductive loop by the movable barrier.

17. A loop detection apparatus comprising:

an inductive loop disposed proximate to a vehicle pathway access to which is periodically restricted by a movable barrier at least partially controlled by a movable barrier operator, wherein the inductive loop is disposed at least partially above a surface on which a vehicle travels;

a processing device comprising circuitry configured to connect to the inductive loop and sense from the inductive loop a change in inductance of the inductive loop;

wherein the processing device is configured to:

detect a change in inductance of the inductive loop beyond at least a first and a second threshold value, in response to detecting the change in inductance of the inductive loop beyond the first threshold value, transmit a first signal configured to effect a first action, in response to detecting the change in inductance of the inductive loop beyond the second threshold value, transmit a second signal configured to effect a second action different from the first action;

wherein the first and the second action comprise one or more of:

causing the movable barrier operator to effect movement of the movable barrier; causing the movable barrier operator to restrict movement of the movable barrier; or causing an action by an accessory device associated with the processing device.

* * * * *